United States Patent [19]

Bergstrom

[11] 4,138,960

[45] Feb. 13, 1979

[54] SAILBOAT CONSTRUCTION

[76] Inventor: Lars R. Bergström, Lands End, Longboat Key, Fla. 33548

[21] Appl. No.: 789,956

[22] Filed: Apr. 22, 1977

[51] Int. Cl.[2] ..... B63B 35/00

[52] U.S. Cl. ..... 114/39; 9/6 R

[58] Field of Search ..... 114/39, 56, 65 R, 81, 114/90; 9/2 R, 2 C, 2 S, 2 F, 6 R, 6 M, 6 P, 6.5

[56] References Cited

U.S. PATENT DOCUMENTS

| | | | |
|---|---|---|---|
| 224,346 | 2/1880 | McDonald | 9/2 C |
| 3,648,310 | 3/1972 | Butler | 9/6 P |

FOREIGN PATENT DOCUMENTS

| | | | |
|---|---|---|---|
| 857759 | 10/1952 | Fed. Rep. of Germany | 9/6 R |
| 794423 | 2/1936 | France | 9/2 C |
| 2234181 | 6/1973 | France | 9/6 P |

*Primary Examiner*—Trygve M. Blix
*Assistant Examiner*—Jesus D. Sotelo
*Attorney, Agent, or Firm*—William E. Mouzavires

[57] ABSTRACT

A sailboat of the positive displacement type having a novel construction including transverse and longitudinal interior tubular structural frames for absorbing the loads from the mast including the rigging system and the fore and aft stays as well as the loads from the keel. The structural support frames may be prefabricated and are inserted in and attach to, a hull shell which because of the strength and load-absorbing capacity of the frames, may be made from a thin lightweight construction, for example, a balsa core sandwiched by Fiberglas skins. The hull shell is formed separately from the frames and its strength need only be sufficient for absorbing the forces of the sea since the stresses and strains from the aforementioned loads are absorbed substantially entirely by the internal support frames. The transverse support frame supports the mast with the shrouds being fastened through chain plates to opposite sides of this frame. In addition, the keel is fixed to the transverse frame. The fore and aft stays are fixed to the opposite ends of the longitudinal frame which resists bending about transverse axes. After the internal frames are inserted in and attached to the hull shell, the deck is installed and it may be supported by either the longitudinal frame or the hull shell but in either instance, no bulkheads are required.

29 Claims, 3 Drawing Figures

SAILBOAT CONSTRUCTION

OBJECTS OF INVENTION

The present invention generally relates to constructions for sailboats of the positive displacement type and more specifically, the present invention relates to a novel sailboat construction as well as a method of construction.

A primary object of the present invention is to provide a novel sailboat construction as well as method of construction which will result in a substantial reduction in the overall weight of the hull without sacrificing strength and rigidity of the hull. Included herein is such a novel construction which may be utilized not only to reduce the weight of the hull but at the same time, to increase the rigidity of the hull.

A further object of the present invention is to provide such a sailboat construction and method of construction which avoids the necessity of bulkheads and which does not rely on the strength or rigidity of the hull sheel to absorb the stresses and strains imposed through the mast rigging system, fore and aft stays, and the keel. Included herein is the provision of such a construction which allows a hull shell to be utilized which is extremely lightweight and which need have a strength sufficient to withstand the forces of the sea.

Another object of the present invention is to provide a novel structural support system which may be prefabricated separately from a hull shell and inserted into a lightweight hull shell for purposes of withstanding structural loads and bending forces imposed by the mast and its rigging system, the fore and aft stays and the keel.

SUMMARY OF THE INVENTION

Very briefly described, the present invention provides a structural support frame system preferably composed of a network of aluminum tubular members which are prefabricated separately from and inserted into a lightweight hull shell. The mast is supported on the frame system with its shrouds connected through chain plates secured to the frame system. In addition, the fore and aft stays are connected to the frame system as is the keel so that stresses and strains and bending loads are absorbed substantially by the frame system thereby relieving the hull shell of these loads.

DRAWINGS

Other objects and features of the invention will become apparent from the following more detailed description taken in conjunction with the drawings in which.

DETAILED DESCRIPTION

Figure 1:
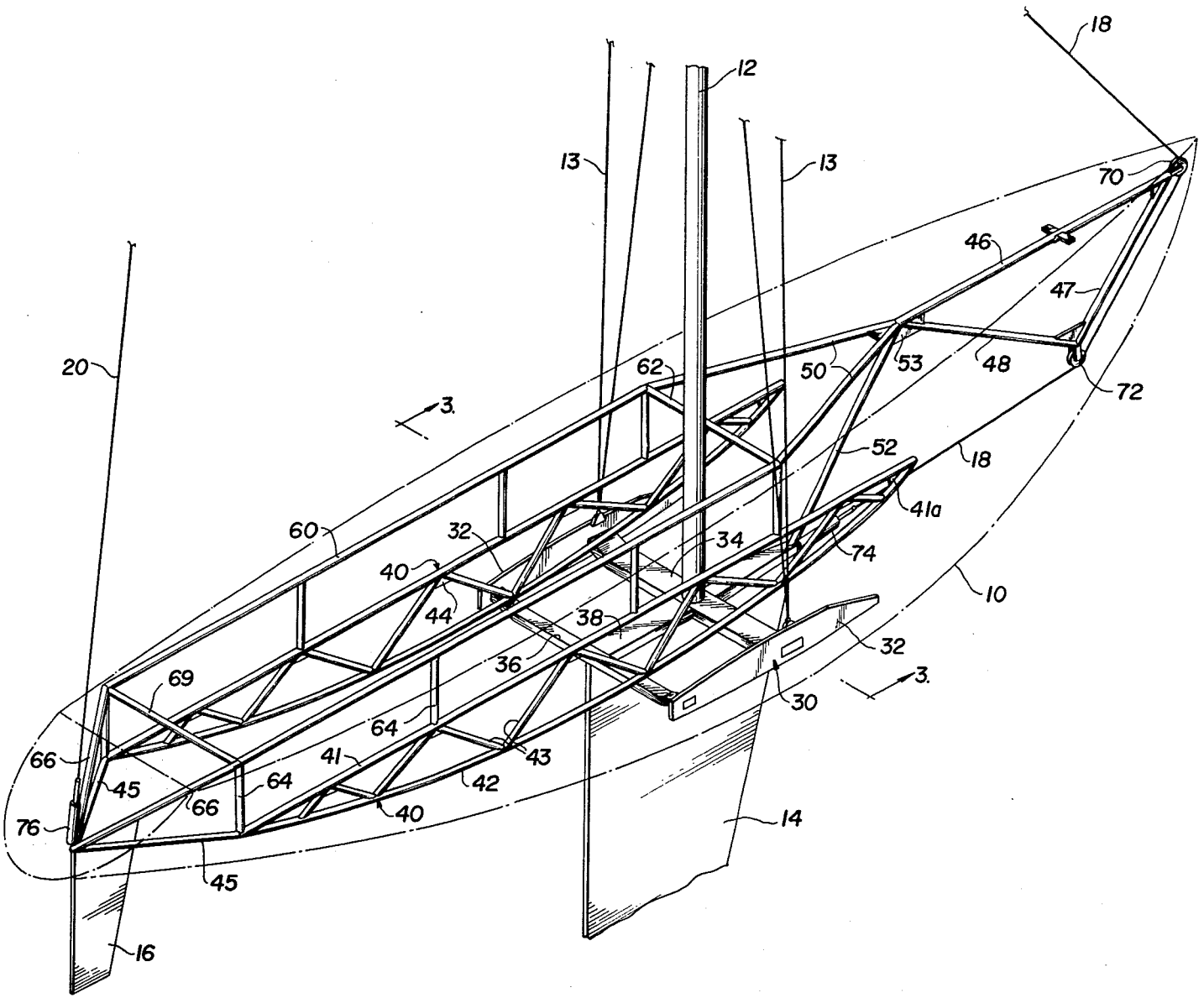
FIG. 1 is a perspective view of a sailboat constructed in accordance with the present invention and shown with certain parts removed for clarity.

Referring now to the drawings, there is shown for illustrative purposes only, a sailboat of the displacement type constructed in accordance with the present invention; the sailboat including a hull shell 10, a mast 12 (only a portion shown) having a rigging system including shrouds 13 on opposite sides of the mast 12, and mast stays including forestay 18 and aftstay 20. At the stern there is shown a rudder 16 and at midships there is illustrated a fixed keel 14. Although not shown, a keel box for housing a retractable keel or a centerboard keel may be utilized in place of the fixed keel shown. Therefore in the claims, the term "keel means" will be utilized to cover either the fixed keel 14 shown or a keel box or equivalent structure.

In accordance with the present invention, the shell hull 10 is formed from a lightweight construction which, in one preferred form of the invention, may include Fiberglas skins sandwiching a balsa core. In addition, carbon filbers may be incorporated in the Fiberglas skins at high stress areas. However, any other suitable lightweight hull shell construction may be employed; and in accordance with the invention, the strength of such a shell need only be sufficient to resist the forces of the sea or water since the stresses and strains including bending loads imposed by the mast, its rigging system, the fore and aft stays, and the keel are to be absorbed by an internal structural support frame system to be described. Moreover, because of such a support frame system, the hull shell need not include any bulkheads as are commonly used in conventional boat construction.

In the specific embodiment of the invention shown, the novel structural support frame system of the present invention includes what will be referred to as a first frame generally designated 30 located intermediate the ends of the hull at the bottom of the hull and extending transversely across the hull. This frame 30 includes opposite side pieces in the form of lightweight plates 32 preferably made from aluminum plate material. Plates 32 are interconnected by cross pieces 34 and 36 which extend transversely across the hull and are made from a tubular construction preferably aluminum plates welded together to form tubular members. Cross pieces 34 and 36 are welded to side plates 32 as shown. In addition, frame 30 includes a longitudinally extending centerpiece 38 fixed such as by welding to cross pieces 34 and 36 and also being formed of a tubular construction from aluminum plates welded together into the configuration shown. Centerpiece 38 extends along the longitudinal axis of the sailboat.

Mast 12 is supported in the specific embodiment shown on frame 30 and in particular, rests on centerpiece 38. Shrouds 13 of the rigging system are fastened through chain plates (not shown) to side plates 32 of frame 30 so that any forces acting about longitudinal axes through the shrouds 13 will be absorbed by the frame 30. In addition, as shown, the keel 14 is secured to frame 30 and in particular in the specific embodiment shown, to the centerpiece 38 so that all forces exerted through the keel will be absorbed by frame 30. Although not shown, in place of fixed keel 14, a keel box or any other means for housing a retractable keel or centerboard may be employed in which event it would be fixed to the frame 30.

Figure 2:
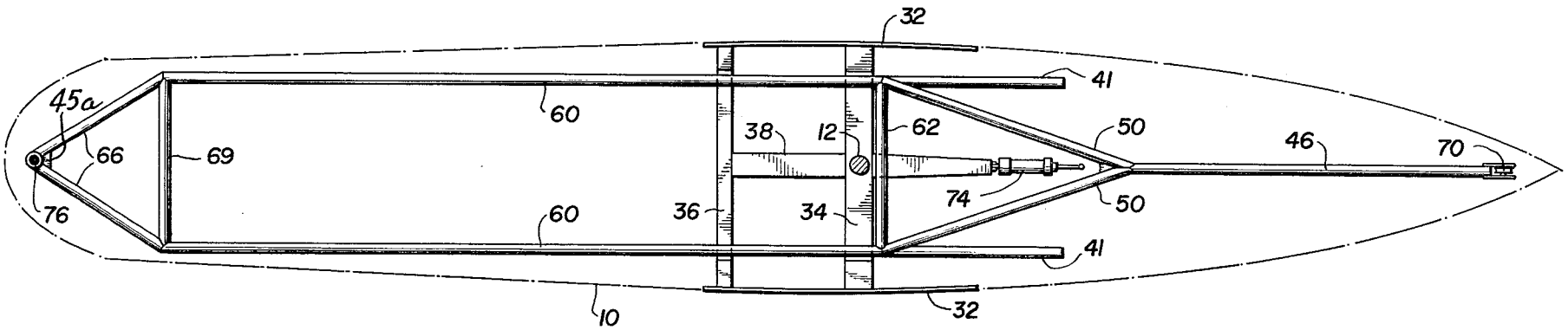
FIG. 2 is a plan view of the sailboat of FIG. 1.
Figure 3:
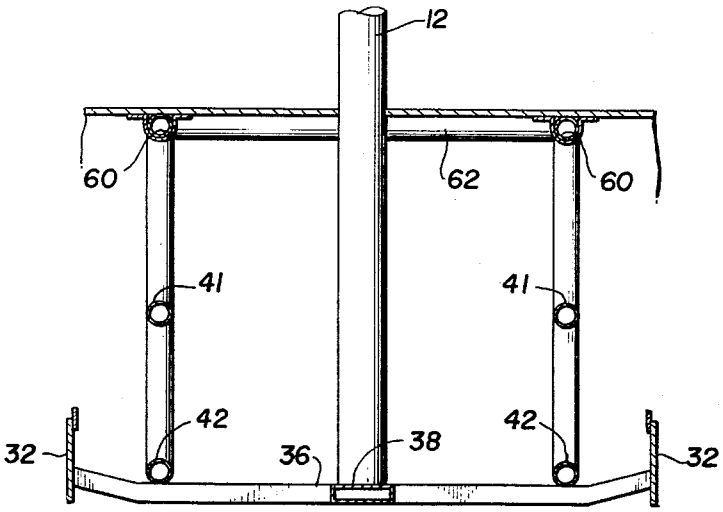
FIG. 3 is a cross-sectional view taken generally along lines 3—3 of FIG. 1.

The structural support frame system further includes what will be referred to as a second frame which extends longitudinally of the hull and which, in the specific embodiment shown, includes two structural beam members in the form of trusses generally designated 40. Each beam member 40 includes upper and lower longitudinally extending chords or structural members 41 and 42 preferably made from aluminum cylindrical tubular stock, for example, being three and one-half inches ($3\frac{1}{2}''$) in diameter and which are welded together at their opposite ends through gusset plates 41*a*. Interconnecting upper and lower longitudinal members 41 and 42 are a series of diagonal struts 43 which are also preferably made from aluminum cylindrical tubes welded to the members 41 and 42 through gusset plates 44 so that each structural beam member 40 is comprised of a truss structure for absorbing bending loads acting about transverse axes. At the stern, beam members 40 are interconnected by means of aluminum cylindrical tubular members 45 which converge towards the stern where they are welded together through the use of a gusset plate 45*a* as shown in FIG. 2. The size of the aluminum tubular members will of course be governed by the strength and rigidity requirements of the particular sailboat design.

The longitudinal framing system further includes at the front of the hull a triangular frame beam comprised of aluminum tubular members 46, 47, 48 which are welded together in a vertical plane extending along the central longitudinal axis of the hull as shown in FIG. 2. This front frame section is anchored through means of a diagonally extending aluminum tube strut member 52 which has its upper end welded at a joint formed between members 46 and 48 at gusset plate 53 and its lower end which may be welded or otherwise bolted to frame 30, for example, to the centerpiece 38 of frame 30. Tubular member 46 extends horizontally over the longitudinal axis at the top of the hull while tubular member 47 extends downwardly from the fore extremity of the hull in a vertical plane including member 46 and follows the contour of the shell hull at the forward extremity thereof as indicated in FIG. 1.

Forestay 18 in the specific embodiment shown is trained about a pulley sheave 70 mounted in the front tubular section 46, 47 and 48 at the forwardmost extremity of that section as shown in FIG. 1 so that loads exerted from forestay 18 are transmitted as compression forces to the member 46. In the specific embodiment shown, forestay 18 is also trained about another pulley sheave 72 mounted at the joint between structural members 47 and 48 so that forces are also transmitted to members 47 and 48 at pulley sheave 72. The extremity of stay 18 is attached to the piston of a hydraulic ram 74 which may be suitably anchored to the structural frame system. In the specific embodiment, ram 74 is anchored to the centerpiece 38 of frame 30 and no structural member is connected to the joint at pulley 72 so that a slight insignificant force will be exerted on the hull shell by structural member 47. However, in another embodiment now shown, a structural member may be interconnected between such points so that no forces are transmitted to the hull shell by member 47. Moreover and although not shown, forestay 18 may be anchored with or without a hydraulic ram at the forward extremity of members 46 and 47.

The aftstay 20 is connected to a piston of a ram 76 which is anchored to the stern of the longitudinal frame section at the gusset juncture 45*a* of frame members 45. It will thus be seen that bending forces acting through the fore and aft stays 18 and 20 about transverse axes will be resisted by the longitudinal frame system including the front frame section 46, 47, 48 and the longitudinal extending beam members 40. It should be understood that the rams 74 and 76 are utilized in the specific embodiment shown as a means for applying hydraulic pressure to trim the mast 12 and that these rams, which themselves form no part of the present invention, may be dispensed with in favor of direct connections of the fore and aft stays 18 and 20 to the longitudinal frame section of the present invention.

Moreover, in other forms of the invention not shown, the aftstay 20 may include a split stay arrangement in which the split stays are respectively connected to the beam members 40 at the rear ends thereof thereby avoiding the need to interconnect the beam members 40 to each other at the stern as in the preferred embodiment illustrated in the drawings.

In the specific embodiment shown, the frame system is also provided with a super structure including elongated members 60 extending longitudinally of the craft above the top members 41 of the beams 40 on which they are supported by means of vertical posts 64 which are welded to members 60 and 41. In addition, converging frame members 50 extend between the forward extremities of members 60 and converge at the gusset plate 53 where they are welded at that joint to receive and counteract some of the forces applied through members 46 and 48. At the stern of the craft, members 60 are interconnected by a cross member 69. In addition, diagonal structural members 66 are welded at the juncture between cross member 69 and rear vertical posts 64 and extend and coverge downwardly to the stern to meet at the joint at gusset plate 45*a*. The members 60, 64, 69 and 66 are also formed from aluminum tubular members welded together.

As will be described below, super structure frame 60, 64, etc., is utilized to support the deck while also functioning to receive some of the load from the front frame section 46, 47 and 48 and the rear end of the longitudinal beams 40. However, in other forms of the invention not shown, a super structure frame need not be employed as the deck may be supported by the hull shell 10.

In assembling the sailboat in accordance with the present invention, the frame system may be prefabricated and welded separately from the hull after which it is inserted into the hull shell 10 into the positions indicated. The frame system may then be positively attached to the hull shell, for example, by straps of Fiberglas or other suitable material received around the tubular frame members and fiberglassed directly to the hull shell. After the frame system is installed and attached to the hull shell, the deck may be attached across the sides of the hull shell to be supported by the super structure frame members 60, 64 to which the deck is positively attached by straps. The rudder 16 may be mounted to the hull shell or instead to a mounting means (not shown) attached to the frame system. The same applies with respect to an engine and propeller assembly (not shown).

Because of the lighter weight and increased rigidity construction achieved by the present invention, the aforedescribed construction is highly suited for racing sailboats or yachts. Sailboats or yachts incorporating the present invention may also be mass produced or custom built and furthermore, the frame system of the present invention permits the stress and strain capacity of the craft to be predetermined accurately by calculations as opposed to conventional constructions which are often overbuilt due to the lack of adequate means to determine the strength and rigidity limits of conventional hulls which are utilized together with bulkheads for resisting the bending loads of the fore-aft stays, shrouds and keel.

In addition, the construction of the present invention does not decrease the overall living space in the hull for bunks, toilets, tables, etc. In fact, the space provided between the beams 40 and the sides of the hull shell is admirably suited for bunks and other accommodations. Moreover, the avoidance of bulkheads by the construction of the present invention adds another space dimension to the interior of the hull.

Although the preferred embodiment shown and described uses a structural support frame comprised of aluminum or aluminum alloy tubular members, other lightweight structural materials such as, for example, reinforced carbon fiber materials may be employed in keeping with the objectives of the present invention.

What is claimed is:

1. A sailboat of the positive displacement type, the sailboat comprising in combination; a first internal structural support frame including portions extending transversely of the sailboat intermediate the ends of the sailboat to absorb loads acting about axes extending longitudinally of the sailboat, a mast mounted to and upstanding from said first support frame and having rigging shrouds connected to the first frame at locations on opposite sides of the mast, a keel means fixed to and depending from the first frame, a second internal structural support frame extending longitudinally in the sailboat at locations fore and aft of the first frame and the mast to absorb bending loads acting about axes extending transversely of the sailboat, fore and aft mast stays connected to fore and aft portions of the second support frame respectively, a shell surrounding and attached to said frames to form a watertight hull enclosure with the first and second support frames functioning to absorb substantially all of the loads including bending loads imparted to the sailboat through the rigging system, fore and aft stays and the keel means, said shell being formed separately from said support frames, wherein said second support frame includes a front section located in the bow of the sailboat and wherein the fore mast stay is connected to said front section.

2. The sailboat defined in claim 1 wherein said shell is made from relatively thin lightweight material of sufficient strength to resist the forces of the sea.

3. The sailboat defined in claim 1 wherein said first and second support frames are connected to each other.

4. The sailboat defined in claim 1 including a deck attached to and supported by said second frame.

5. The sailboat defined in claim 1 which is free of any bulkheads or similar supports.

6. The sailboat defined in claim 1 wherein said first and second frames each include a network of tubular structural membes.

7. The sailboat defined in claim 6 wherein said second frame includes elongated tubular members connected to a truss arrangement.

8. The sailboat defined in claim 6 wherein said shell is made from Fiberglas material.

9. The sailboat defined in claim 1 wherein said second frame includes first and second elongated beam members extending in side-by-side relationship on opposite sides of the boat, and structural members interconnecting said beam members at the stern, and wherein the aftstay is connected to the structural members at the stern.

10. The sailboat defined in claim 9 wherein said beam members are each a truss including upper and lower elongated structural members extending longitudinally of the sailboat and diagonal struts interconnecting said elongated truss members.

11. The sailboat defined in claim 10 wherein said first frame includes a cross piece extending transversely of the boat at the base, and side pieces extending longitudinally of the boat at the sides, the cross piece being fixed to and joining the side pieces, the rigging shrouds being connected to the side pieces, and the mast being supported on the cross piece.

12. The sailboat defined in claim 11 wherein the first frame includes a longitudinally extending member and wherein the keel means is fixed to said last defined longitudinally extending member of the first frame.

13. The sailboat defined in claim 1 wherein said second frame includes first and second elongated beam members extending in side-by-side relationship on opposite sides of the boat with each of the beam members comprised of elongated members connected in a truss arrangement.

14. The sailboat defined in claim 13 wherein said first frame includes a cross piece extending transversely of the boat at the base, and side pieces extending longitudinally of the boat at the sides of the boat, the cross piece being fixed to and joining the side pieces, the rigging shrouds being connected to the side pieces.

15. The sailboat defind in claim 13 wherein said second frame includes a front section located at the front of the boat and connected to said first frame.

16. The sailboat defined in claim 15 further including a superstructure frame fixed to and above said second frame and including frame members connected to the front section of the second frame.

17. The sailboat defined in claim 15 wherein said front section of the second frame includes a plurality of elongated members connected in a triangular configuration extending in a vertical plane.

18. The sailboat defined in claim 1 wherein said second support frame includes first and second elongated beam members extending on opposite side portions of the boat and wherein there is further included means connecting the aft stay to rear end portions of said beam members.

19. A method of constructing a keeled sailboat of the type having a positive displacement hull, the method including the steps of forming a hull shell with no bulkheads from relatively lightweight material, forming separately from the hull first and second structural support frames to absorb the stresses and strains to be imparted to the sailboat through the mast, rigging, keel and fore and aft stays, inserting the frame in the hull shell with the first frame extending generally transversely of and across the hull shell at a bottom portion intermediate the ends of the hull shell and with the second frame extending longitudinally in the hull shell and with a front section included in said second frame being located in the bow, attaching the frames to the hull shell, attaching a keel means to the first frame, installing a mast and rigging system by mounting the mast to said first support frame with the shrouds being connected to opposite side portions of the first frame on opposite sides of the mast, and installing fore and aft stays respectively connected to opposite end portions of the second frame with the fore stay being connected to the front section of said second frame.

20. The method defined in claim 19 further including the step of applying a deck to the boat after the frames are inserted and attached to the hull shell and wherein the deck is fastened to said second frame.

21. The sailboat defined in claim 20 wherein the hull, shell and deck are a Fiberglas construction and wherein the deck is attached to the hull shell.

22. The method defined in claim 19 wherein the frames are made from welded aluminum tubular members.

23. For use in a sailboat of the positive displacement type, a structural support frame system to be formed separately from and secured within the hull shell of the boat; the system comprising, in combination a first frame for absorbing loads acting through rigging shrouds of the boat about axes extending longitudinally of the sailboat, the first frame including a cross piece to extend transversely of the boat at the base, and side pieces joined by the cross piece to be located on opposite side portions of the boat, a second support frame to extend longitudinally in the sailboat at locations fore and aft of the first frame for absorbing bending loads acting through fore and aft mast stays about axes extending transversely of the sailboat, said second frame including first and second beam members extending in spaced side-by-side relationship, said second frame further including a structural front section to be located at the bow of the associated boat and wherein there is further included structural means connecting the first and second frames for anchoring the second frame relative to the first frame when the frames are installed in the associated boat.

24. The system defined in claim 23 wherein said first frame includes a centerpiece extending between said side pieces and across said cross piece and wherein said structural means connecting the first and second frames is fixed to said centerpiece.

25. The system defined in claim 24 wherein said front section of the second frame includes a plurality of elongated members connected into a triangular configurations extending in a vertical plane and wherein said structural means interconnecting said first and second frames is fixed to said front section.

26. The system defined in claim 23 wherein said beam members are trusses.

27. For use in a sailboat of the positive displacement type, a structural support frame system to be formed separately from and secured within the hull of an associated sailboat; the system comprising in combination, a first frame for supporting the mast of the boat and for absorbing loads acting through rigging shrouds of the sailboat about axes extending longitudinally of the boat, the first frame including a crosspiece to extend transversely of the boat and having opposite end portions to be connected to the rigging shrouds, a second support frame to extend longitudinally in the sailboat at locations fore and aft of the first frame for absorbing bending loads acting through the fore and aft mast stays about axes extending transversely of the sailboat, said second support frame including a front section to be located in the bow of the associated boat with the fore stay connected to said front section, said second frame including a rear section to be located generally at the stern of the boat for connecting the aft stays thereto.

28. The structural support frame system defined in claim 27 wherein said first support frame includes a centerpiece extending transversely of said crosspiece and adapted to have mounted thereto a keel of the associated boat.

29. The structural support frame system defined in claim 28 further including structural means interconnecting said front section of said second support frame and said centerpiece of said first support frame.

* * * * *

UNITED STATES PATENT AND TRADEMARK OFFICE

CERTIFICATE OF CORRECTION

PATENT NO. : 4,138,960

DATED : February 13, 1979

INVENTOR(S) : LARS R. BERGSTRÖM

It is certified that error appears in the above-identified patent and that said Letters Patent are hereby corrected as shown below:

Column 3, line 50, "now" should be -- not --,

Column 7, line 34, "tions" should be -- tion --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*